United States Patent [19]

Chikatani

[11] Patent Number: 4,732,643

[45] Date of Patent: Mar. 22, 1988

[54] BINDING APPARATUS

[75] Inventor: Hajime Chikatani, Hachioji, Japan

[73] Assignee: Daisei Kikai Kabushiki Kaisha, Tokyo, Japan

[21] Appl. No.: 911,997

[22] Filed: Sep. 26, 1986

[30] Foreign Application Priority Data

Oct. 1, 1985 [JP] Japan ..... 60-218542

[51] Int. Cl.[4] ..... B65B 51/08; B65B 61/00

[52] U.S. Cl. ..... 156/459; 156/443; 156/446; 156/468; 156/475; 156/486; 53/137; 53/580; 53/583

[58] Field of Search ..... 156/443, 459, 468, 475, 156/486, 446; 53/580, 583, 137; 100/10, 15, 18

[56] References Cited

U.S. PATENT DOCUMENTS 3,321,352 5/1967 Sejda ..... 156/486 X
3,910,005 10/1975 Thimon et al. ..... 53/580 X
4,091,595 5/1978 Pelster ..... 53/137 X
4,457,802 7/1984 Yanagihara ..... 156/446 X

*Primary Examiner*—Donald E. Czaja
*Assistant Examiner*—Jeff H. Aftergut
*Attorney, Agent, or Firm*—Oblon, Fisher, Spivak, McClelland & Maier

[57] ABSTRACT

A binding apparatus in which an adhesive tape is wound several times around an article to be bound, thereby binding the article. The binding apparatus includes a rotary table having a bobbin rotatably retained thereon, an adhesive tape feeding device for winding a given length of an adhesive tape around the bobbin, and a driving device for rotating the rotary table. The rotary table is rotated around the article to be bound by means of the driving device so that the adhesive tape wound around the bobbin on the rotary table is wound around the article to be bound.

8 Claims, 10 Drawing Figures

BINDING APPARATUS

FIELD OF THE INVENTION

The present invention relates to a binding apparatus for winding an adhesive tape several times round an article to be bound for example, the opening of a bag filled with goods. In practice, the bag is puckered, and an adhesive tape is wound round the puckered opening of the bag, thereby binding the opening.

BACKGROUND OF THE INVENTION

In order to pucker and bind the opening of a bag filled with goods, there has been hitherto carried out such a way of winding a wire round the opening and caulking the wire, or winding an adhesive tape round there by hand. However, there has been not known a technique of carrying out such binding by a machine automatically.

OBJECTS OF THE INVENTION

The present invention is intended to provide a binding apparatus in which an adhesive tape is automatically wound several times round an article to be bound, thereby binding the article to be bound.

It is another object of this invention to provide an automatic binding apparatus in which a given length of an adhesive tape is previously wound round a bobbin rotatably retained on a rotary table, and this adhesive tape is wound round an article to be bound by the rotation of the rotary table.

SUMMARY OF THE INVENTION

The present invention provides a binding apparatus comprising a rotary table having a bobbin rotatably retained thereon, an adhesive tape feeding device for winding a given length of an adhesive tape round the same bobbin, and a driving device for rotating the rotary table. The rotary table is rotated around an article to be bound by means of the driving device so that the adhesive tape wound round the bobbin on the rotary table is wound several times round the article to be bound, thereby binding the article to be bound.

The present invention will be concretely described with reference to one embodiment shown in the accompanying drawings.

DETAILED DESCRIPTION OF THE PRESENTLY PREFERRED EMBODIMENT OF THE INVENTION

Figure 1:
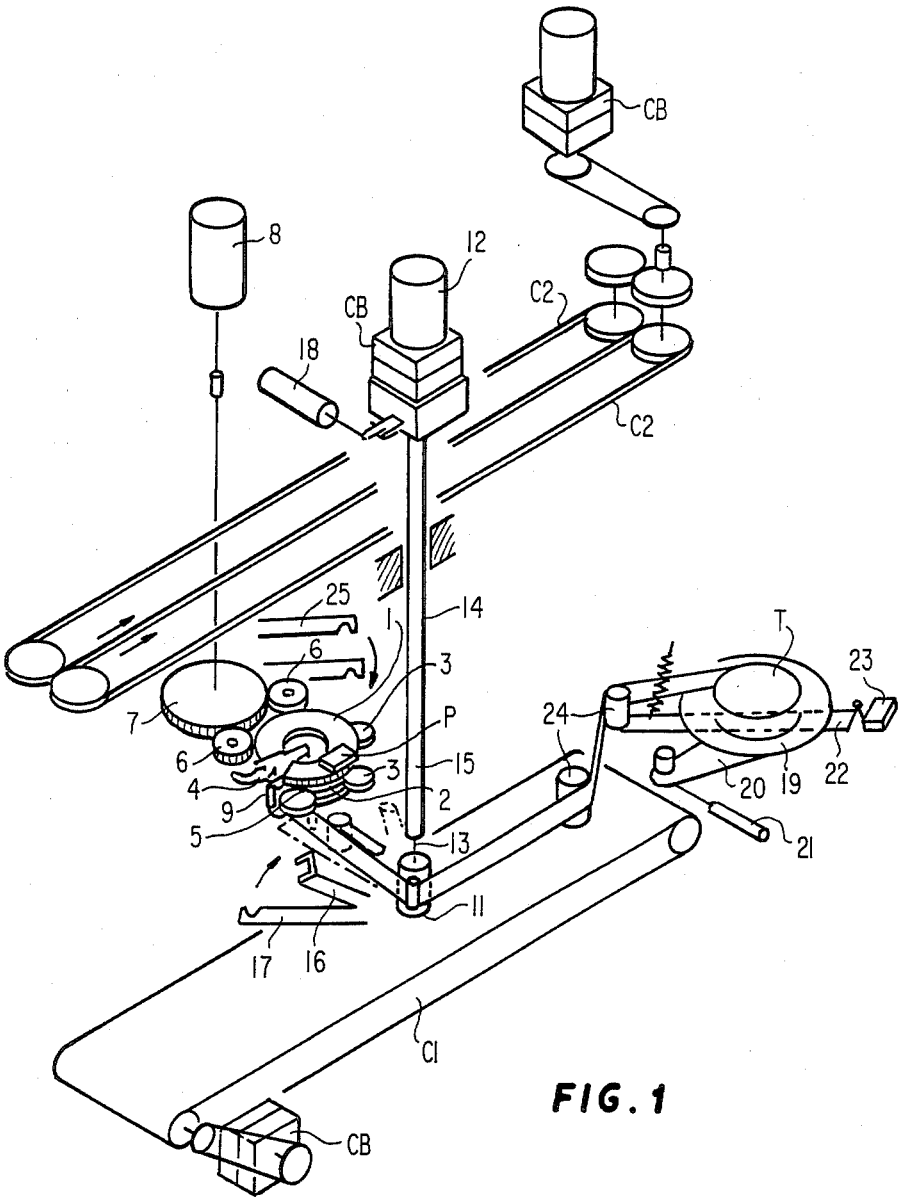
FIG. 1 is a perspective view illustrating schematically one embodiment of a binding apparatus according to the present invention.

In the accompanying drawings, the reference numeral 1 represents a rotary table supported rotatably round its axis by six supporting rollers 3 which are rotatable in engagement with grooves 2 in the circumference of the rotary table 1.

The rotary table 1 has a V-shaped groove 4 formed leading from a part of its circumference to the center thereof.

On the outer circumference of the rotary table 1, teeth 5 are formed which mesh with the teeth of driving gears 6,6.

The driving gears 6,6 mesh with a driving gear 7 which is rotated in the proper and reverse directions by means of a pulse motor 8 rotatable in the proper and reverse directions.

One bobbin 9 is rotatably retained on the rotary table 1, this is on its back side, as can be seen from the state shown in FIG. 1.

Two rotation-free rollers 10,10 are rotatably retained in such a state that they hold the bottom of the V-shaped groove 4 of the rotary table 1 from both the sides.

On the other hand, a delivery roller 11 for sending out an adhesive tape to be wound onto the bobbin 9 is laid by the rotary table 1, and the delivery roller 11 is driven for rotation by way of a driving shaft 13 by a motor 12.

A turning shaft 14 is arranged coaxially with the driving shaft 13, and a rocking bracket 15 is attached on the turning shaft 14. A cutter 16 and a positioning bar 17 for an article to be bound are attached on the rocking bracket 15. On the turning shaft 14, there is attached an arm A (see FIG. 3) for supporting a roller R on which an endless belt B (see FIG. 4) is stretched. The endless belt B is driven synchronously with the delivery roller 11 by the rotation of the driving shaft 13.

The turning shaft 14 is turned by a given angle by means of a cylinder 18, whereby the cutter 16 and positioning bar 17 are moved to turn as shown by the arrow in FIG. 1.

Next, a mechanism for sending out a given length of an adhesive tape toward the delivery roller 11 will be described.

The reference numeral 19 in FIG. 1 represents a frame for retaining a reel for an adhesive tape T. The frame 19 has a cylinder 21 attached thereon by way of an arm 20.

A detection bar 22 is attached on the frame 19, and the detection bar 22 is adapted to engage with a limit switch 23.

Accordingly, when the given length of the adhesive tape T is unwound from the reel by rotating the frame 19 by means of the cylinder 21, and sent out to the delivery roller 11, the detection bar 22 is engaged with the limit switch 23 to stop the delivery of the adhesive tape.

Figure 3:
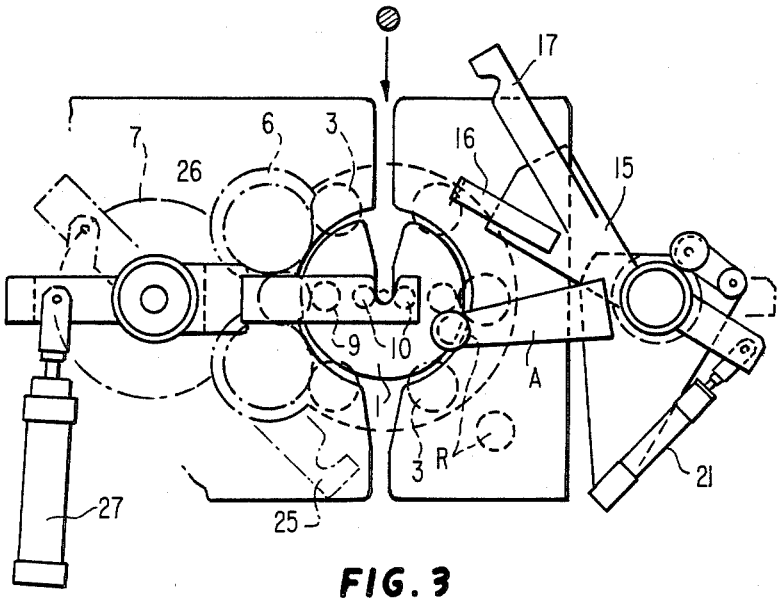
FIG. 3 is a plan view of FIG. 2.
Figure 4:
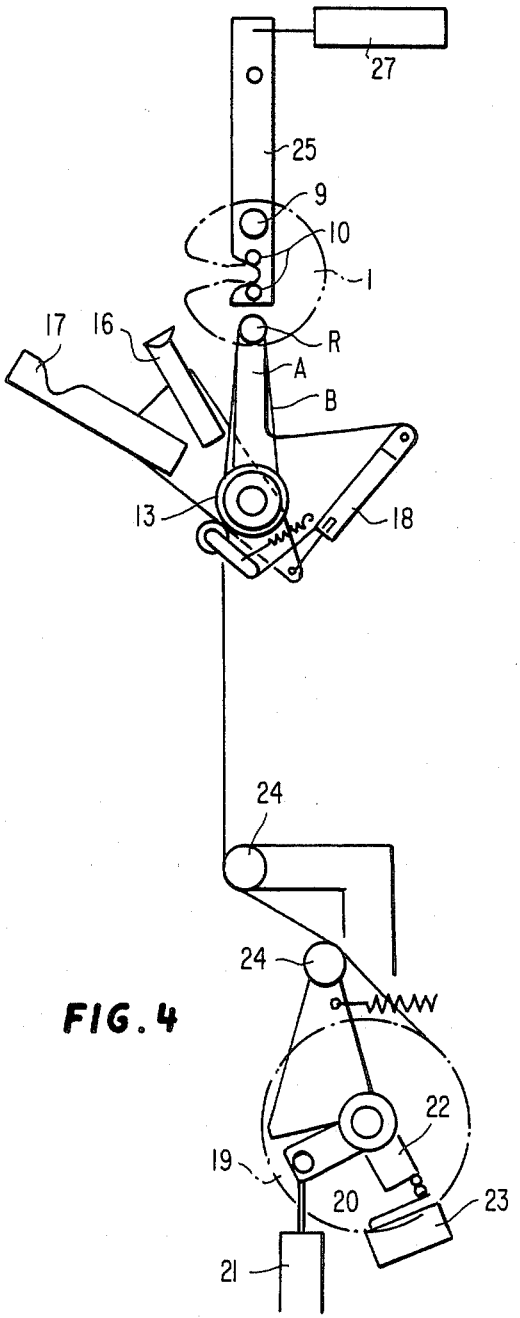
FIG. 4 is an illustrative view showing an adhesive tape feeding mechanism in FIG. 1.

The reference numeral 24 represents guide rolls for guiding the adhesive tape. As shown in FIG. 3, a receiving bar 25 for receiving, at the opposite side to the positioning bar 17, the article to be bound, which is sent into the V-shaped groove 4 of the rotary table 1 by means of the positioning bar 17, is attached on a shaft 26, at the opposite side to the delivery roller 11 with the rotary table 1 held between them. The shaft 26 will be turned between a receiving position shown by the solid line and a retreated position shown by the phantom line in FIG. 3, by means of a cylinder 27.

In FIG. 1, the designation C1 represents a conveyor for conveying a bag filled with package goods, whose opening is to be bound, as the article to be bound.

The designation C2 represents two endless belts arranged in parallel over the conveyor C1, which serve to convey the bag to be bound in such a manner that its puckered opening is held between two belt zones running in parallel.

In addition, the designation CB in the drawings represents clutch brakes for transmitting and interrupting the rotating force from a driving device.

The designation P in FIG. 1 represents a photoelectric tube for detecting the article to be bound.

The operation of the above-mentioned embodiment will be described hereinafter.

Figure 2:
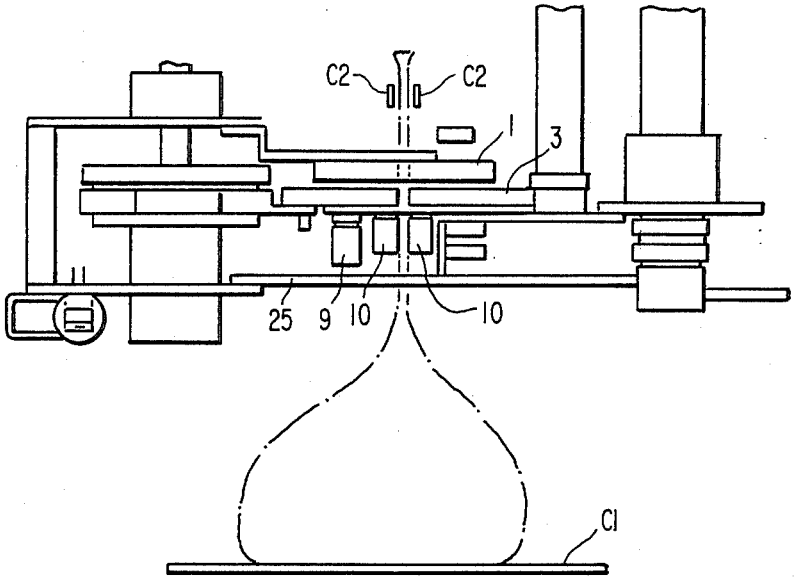
FIG. 2 is a side view showing a portion of the rotary table enlarged.

As shown by the phantom line in FIG. 2, the bag filled with package goods is put on the conveyor C1 and it is being sent with its puckered opening held between the belts C2. When the puckered opening of the bag which is the article to be bound is sent into the V-shaped groove 4 of the rotary table 1, the photoelectric tube P detects the same opening so that the clutch brakes CB of the driving devices for the conveyor C1 and belts C2 are taken on to stop them.

When the article to be bound has been thus received in the V-shaped groove 4 of the rotary table 1, the adhesive tape T is wound several times round the article to be bound, at that position, to effect its binding.

In the next place, how to effect the binding will be described below.

FIG. 5 to FIG. 10 are illustrative views of the winding of an adhesive tape round a portion to be bound, caused by the rotary table 1.

Figure 5:
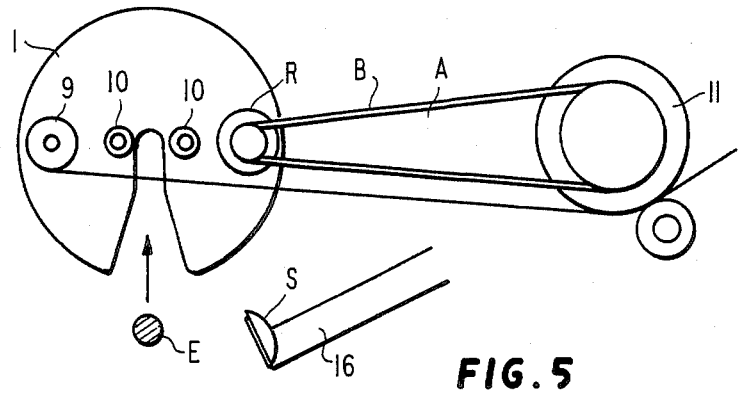
FIGS. 5 to 10 are plan views illustrating the binding operation of the binding apparatus shown in FIGS. 1 to 4.

FIG. 5 shows the state that the adhesive tape T from the reel of the adhesive tape described in FIG. 1 has been wound by a given length onto the bobbin 9 of the rotary table 1.

Under this state, the puckered opening E of a package bag as the article to be bound is being sent into the V-shaped groove 4 of the rotary table 1.

Figure 6:
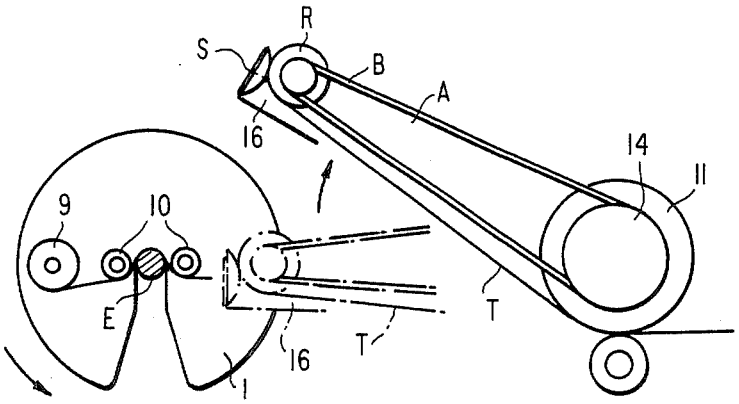

Then, the article E to be bound is partially stuck, in the state shown in FIG. 6, onto the adhesive tape which is supported at the bottom of the V-shaped groove 4 by the rotation free rollers 10.

Under that state, the turning shaft 14 is turned, and the cutter 16 is displaced as shown in FIG. 6, thereby cutting the adhesive tape T.

The end of the thus-cut adhesive tape T at the reel side is caused to adhere onto a spring plate S attached on the back side of the cutter 16 and retained as it is held between the spring plate S and the roller R.

Then the cutter 16 and the arm A are turned in one body, as shown in FIG. 6, and stopped after they come to a position separated from the rotary table 1.

Figure 7:
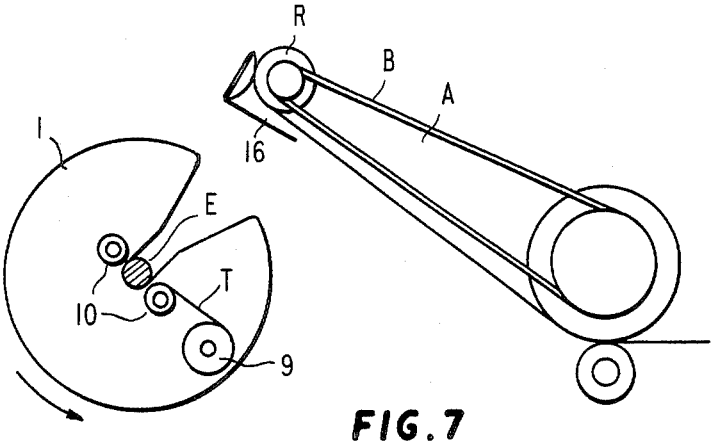

The rotary table 1 is then rotated several times around its center, as shown in FIG. 7, in accordance with the rotation of the driving gear 7. At that time, the adhesive tape T which has been previously wound round the bobbin 9 is unwound and wound round the article E to be bound, because the article E to be bound is being rest at the bottom of the V-shaped groove 4 which is the center of the rotary table 1.

Figure 8:
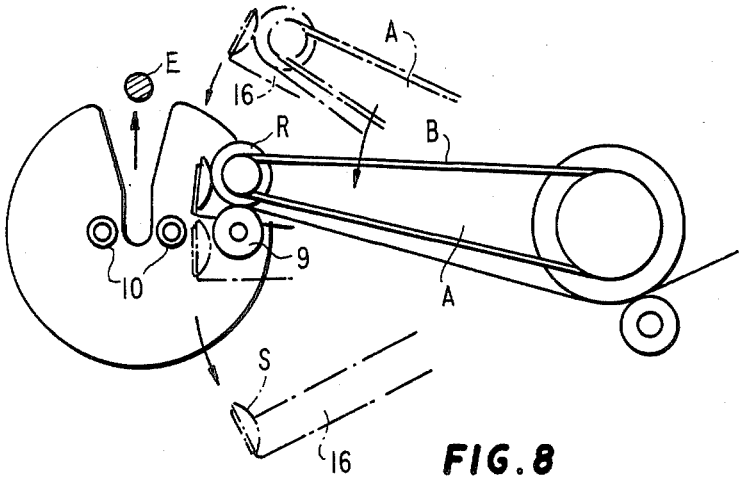

Then, the rotary table 1 is stopped at the position shown in FIG. 8 where it has been rotated 180° from the initial state, and the article E to be bound on which the adhesive tape has been wound several times is discharged.

Thereafter, the arm A and cutter 16 are turned from the position of the phantom line shown in FIG. 8 to the position of the solid line.

When the roller R comes at the position where it contacts with the bobbin 9, the turning of the arm A is stopped so that only the cutter 16 is turned to separate therefrom as shown by the phantom line.

Figure 9:
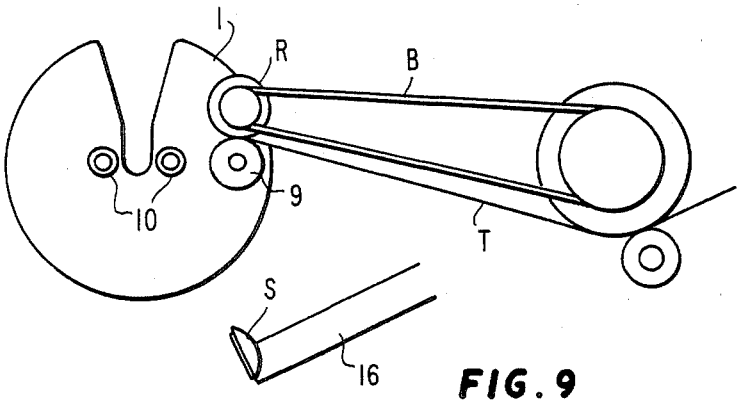

At that time, the adhesive tape T with its end retained as it is held between the spring plate S of the cutter 16 and the roller R, is transferred in the state that it is to be stuck onto the surface of the bobbin 9. This state is shown in FIG. 9. When the endless belt B is driven by the rotation of the driving shaft 13 under that state, the roller R is rotated to rotate the bobbin 9, and as a result, the adhesive tape T which is drawn out by the delivery roller 11 rotated by the rotation of the driving shaft 13 is wound by the given length onto the bobbin 9.

The adhesive tape at that time is fed by the given length with the predetermined rotation of the real of the adhesive tape, caused by the cylinder 21 or the like, as previously described in FIG. 1.

Figure 10:
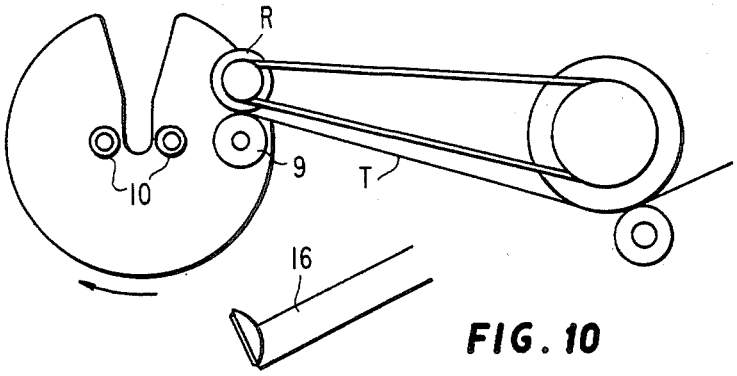

When the winding of the adhesive tape onto the bobbin 9 is completed, the rotary table 1 is clockwise rotated 180° as shown in FIG. 10, to provide the state that the stand-by for receiving a next article to be bound as shown in FIG. 5 has been completed.

Thus, such a binding operation will be repeated.

Although the above-described embodiment is one in which the adhesive tape is retained as it is held between the spring plate S attached to the cutter 16 and the roller R at the end of the arm A, it may be modified to one in which a bar which is caused to move by an air cylinder is attached, in place of the spring plate, on the back side of the cutter 16, and the adhesive tape T is retained by being held between the bar and the roller R.

Furthermore, of course, there may be adopted various compositions as to a mechanism for sending out the adhesive tape T by a given length, without limiting the invention to the mechanism shown in the drawings.

As described concretely with reference to the embodiment, the binding apparatus according to the present invention is one in which a given length of an adhesive tape is previously wound onto a bobbin on a rotary table, and the rotary table is then rotated around an article to be bound, thereby winding the adhesive tape on the bobbin round the article to be bound. Thus, the present invention has provided a binding apparatus in which the winding of an adhesive tape round an article to be bound can be automatically carried out several times.

What I claim is:

1. A binding apparatus comprising:

(a) a table having a central axis, a circumferential periphery, and a groove extending from said circumferential periphery to the center of said table, said groove being sized, shaped, and positioned to permit an object to be bound to be moved from an external ready position to a work position in which the object is located on said central axis of said table and said table can rotate around the object and from the work position to an external finished position;

(b) first means for conveying an object to be bound from the external ready position to the work position and from the work position to the external finished position;

(c) second means for rotating said table in either direction;

(d) a bobbin mounted on a first side of said table in parallel to but offset from said central axis of said table; and (e) third means for attaching a first end of an adhesive tape to said bobbin, for wrapping the adhesive tape around said bobbin a predetermined number of times, for cutting the adhesive tape to form a second end of a piece of adhesive tape sufficient in length to pass several times around the object to be bound, for positioning the portion of the piece of adhesive tape between said bobbin and the second end of the adhesive tape so that said portion is at least approximately parallel to said first side of said table and so that said portion passes over said groove at least approximately transversely to said groove, for gripping the second end of the adhesive tape while said first means conveys an object to be bound from the external ready position to the work position, during which motion the object strikes the portion of the adhesive tape between said bobbin and the second end of the adhesive tape, and for releasing the second end of the adhesive tape before said second means rotates said table several times, thereby unwinding the piece of adhesive tape from said bobbin and winding the piece of adhesive tape around the object to be bound.

2. A binding apparatus as recited in claim 1 wherein:

(a) said first means comprises means for moving the object to be bound in a straight line;

(b) said table is located at a ready position when the object enters said groove; and (c) said table is located at a finished position 180° from its ready position when the object exits said groove.

3. A binding apparatus as recited in claim 1 wherein said groove is wider in the circumferential direction at said circumferential periphery of said table than it is at the center of said table.

4. A binding apparatus as recited in claim 1 wherein said second means comprise:

(a) a gear train operatively connected to said table and (b) a pulse motor operatively connected to said gear train.

5. A binding apparatus as recited in claim 1 wherein said bobbin is rotatable relative to said table about a central axis parallel to but offset from the central axis of said table.

6. A binding apparatus as recited in claim 1 and further comprising a pair of guide projections mounted on the first side of said table in parallel to said central axis of said table and immediately adjacent to said groove, one of said pair of guide projections being located on each side of said groove to act as a guide and support for an object to be bound.

7. A binding apparatus as recited in claim 6 wherein said guide projections are rotation-free rollers.

8. A binding apparatus as recited in claim 6 wherein said guide projections and said bobbin are at least approximately colinear.

* * * * *